US012599261B2

(12) United States Patent
Nelson et al.

(10) Patent No.: US 12,599,261 B2
(45) Date of Patent: Apr. 14, 2026

(54) BEVERAGE FLIGHT COOLER

(71) Applicants: Lisa S. Nelson, Irving, TX (US); Paul D. Nelson, Irving, TX (US)

(72) Inventors: Lisa S. Nelson, Irving, TX (US); Paul D. Nelson, Irving, TX (US)

( * ) Notice: Subject to any disclaimer, the term of this patent is extended or adjusted under 35 U.S.C. 154(b) by 0 days.

(21) Appl. No.: 18/592,772

(22) Filed: Mar. 1, 2024

(65) Prior Publication Data

US 2024/0292968 A1 Sep. 5, 2024

Related U.S. Application Data

(60) Provisional application No. 63/488,315, filed on Mar. 3, 2023.

(51) Int. Cl.
*A47G 23/02* (2006.01)

(52) U.S. Cl.
CPC .. *A47G 23/0208* (2013.01); *A47G 2023/0275* (2013.01)

(58) Field of Classification Search
CPC .... A47G 2023/0275; A47G 2023/0283; A47G 2023/0291; A47G 23/0208; A47G 23/02; A47G 23/0216; A47G 23/0241; A47G 23/0266; A47G 23/03
See application file for complete search history.

(56) References Cited

U.S. PATENT DOCUMENTS

| | | | | |
|---|---|---|---|---|
| D592,911 | S * | 5/2009 | Buchanan | D7/701 |
| 7,805,959 | B2 * | 10/2010 | Webb | A63B 67/002 62/530 |
| 10,098,488 | B2 * | 10/2018 | Boyatt | A47G 23/0641 |
| 2013/0118943 | A1 * | 5/2013 | Furey | B65D 21/0231 206/427 |
| 2019/0024970 | A1 * | 1/2019 | Sapia | A47G 23/0641 |

* cited by examiner

*Primary Examiner* — Javier A Pagan

(74) *Attorney, Agent, or Firm* — Law Office of Jeff Williams PLLC; J. Oliver Williams

(57) ABSTRACT

A beverage cooler assembly comprising a cooler case, a cooler lid coupled to an upper surface of the cooler case so as to define an internal volume, and a cooler pack located within the internal volume. The cooler case having one or more ribs along an upper surface to elevate the cooler pack. The cooler lid including a container aperture permitting access into the internal volume. The cooler pack having a recess aligned with the container aperture and configured to accept a beverage container. The cooler pack being insulative to regulate the temperature of the beverage in the container as it rests in the recess.

8 Claims, 4 Drawing Sheets

BEVERAGE FLIGHT COOLER

CROSS REFERENCE TO RELATED APPLICATIONS

This application claims the benefit of an earlier filing date and right of priority to U.S. Provisional Application No. 63/488,315, filed 3 Mar. 2023, the contents of which is incorporated by reference herein in its entirety.

BACKGROUND OF THE INVENTION

1. Field of the Invention

The present application relates to a drink cooler, and more particularly to a cooler for the serving of a flight of drinks.

2. Description of Related Art

Wine and beer tasting have been popular for almost as long as the drinks themselves. In China, there is evidence of winemaking as far back as 9,000 years. To be able to assess the quality of the produce before purchasing, wine tasting became necessary as the trading of wine developed. Beginning in the 1300s, a more scientific methodical approach to wine tasting began to emerge. Up until recently, only suppliers, merchants, and winemakers were allowed to taste wine and wine tasting has grown in popularity as a leisure activity since the 1980s.

Similar to wine tasting, beer tasting is a means to discover more about the production, ingredients, and history of beer as well as various beer types, hops, and yeast. Analyzing the beer's look, aroma, and flavor is a frequent method. Beer's introduction into the globe flourished at various times and in various places.

The enjoyment of cold drinks is a modern experience sourced by the introduction of mechanical refrigeration. Previous to modern mechanical means of refrigeration, the historical process of keeping food and drinks cold was derived from ice harvested during winter months and stored. Ice was collected and shipped as a mass-market commodity to warm climate destinations. Highly insulated ice houses were constructed as storage facilities in the summer months or in southern locations where local harvesting of ice was not possible. While in today's modern age, beverages intended to be consumed cooled are stored via mechanical refrigeration; however, once ready to consume it can be challenging to maintain this cooler beverage temperature if it is not intended to be served over ice.

Lovers of craft beer and wine enjoy tasting smaller samples of new beverages in a "flight" of these beverages. Some of these beverages are intended to be served at cooler temperatures for their optimum flavor and enjoyment. Lead researchers claim that temperature has an impact on our sense of taste and perception. When something is cold, the bitter flavor is stronger and last longer. When something is heated, the astringent flavor—a dry tasting sensation brought on by tannins—is stronger and the flavor lasts longer. When something is warm, the sour flavor is stronger and lasts longer. Although the sweetness is unaffected, when something is cold, it takes longer to attain its peak sweetness.

The tasting of beverages is important and should not be rushed. Warming of beverages to be consumed is counterproductive and can affect the taster's perception of the quality of the beverages. Breweries, wineries, restaurants or other establishments that serve sample flights with several beverages are particularly vulnerable to the beverages getting warmer than intended prior to being consumed and enjoyed. This is a concern for both the attendees of the events and the suppliers who depend on them to attract sales from both consumers and retailers.

BRIEF SUMMARY OF THE INVENTION

It is an object of the present application to provide a beverage flight cooler that is configured to improve on the traditional paddle or flight holder for beer and wine. The assembly includes an enclosed space in the design will accommodate a customized cooler pack thick enough to maintain an optimal drinking temperature of fluid within one or more cups or glasses held therein. It is an object of the present application to allow for the cooler packs to be sized to handle both cans, glasses, and even bottles. The cooler pack is removable and may be chilled separately or left at room temperature. The assembly includes a plurality of apertures within a cooler lid that align with the cooler packs to accept the cup, glass, or bottle.

Another object of the present application is to provide a cooler case to support the cooler packs and lid and to collect any moisture which may develop. A plurality of feet may be used to provide grip on serving surfaces. The assembly may be handled easily via handle apertures formed in the cooler case adjacent to recesses in the cooler lid. Use of the assembly will assist in insulating beverages and maintaining desired temperatures.

Ultimately the invention may take many embodiments. In these ways, the present invention overcomes the disadvantages inherent in the prior art. The more important features have thus been outlined in order that the more detailed description that follows may be better understood and to ensure that the present contribution to the art is appreciated. Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present design. It is important, therefore, that the claims be regarded as including such equivalent constructions insofar as they do not depart from the spirit and scope of the present application.

BRIEF DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
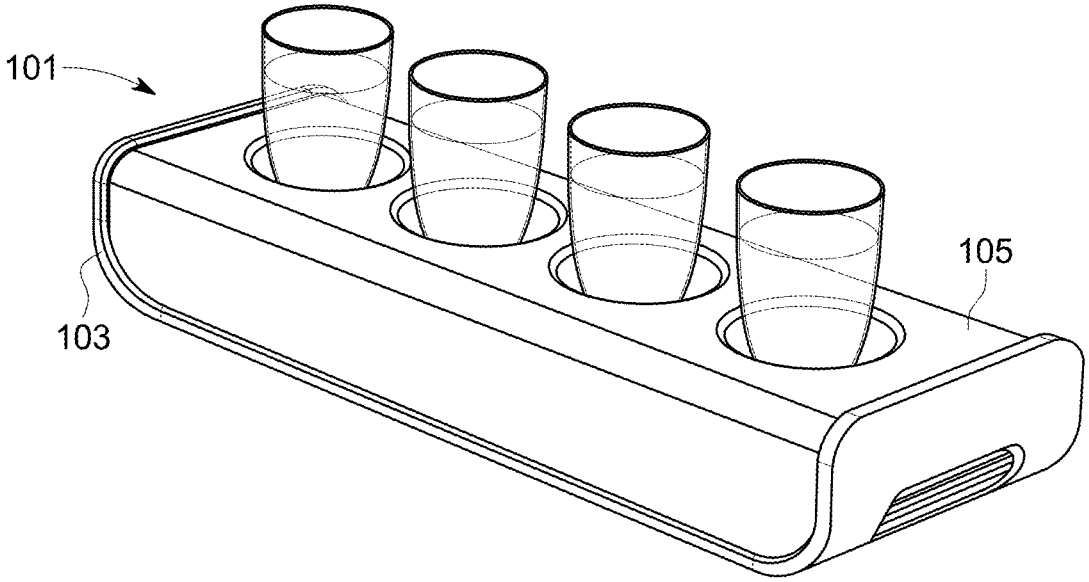
FIG. 1 is a perspective view of a beverage flight cooler according to an embodiment of the present application.

While the embodiments and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE INVENTION

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

The embodiments and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The embodiments of the present application are illustrated in the associated drawings. The beverage flight cooler assembly includes a cooler case configured to support and insulative cooler pack and a cooler lid. The cooler pack is nestled between the cooler lid and the cooler case and is configured to be sized to accept either glasses, cans, or even bottles of beverages. The assembly of the present application is configured to insulate and selectively regulate the temperature of beverages in the environment. Additional features and functions are illustrated and discussed below.

Referring now to the Figures wherein like reference characters identify corresponding or similar elements in form and function throughout the several views. The following Figures describe embodiments of the present application and its associated features. With reference now to the Figures, embodiments of the present application are herein described. It should be noted that the articles "a", "an", and "the", as used in this specification, include plural referents unless the content clearly dictates otherwise.

Figure 2:
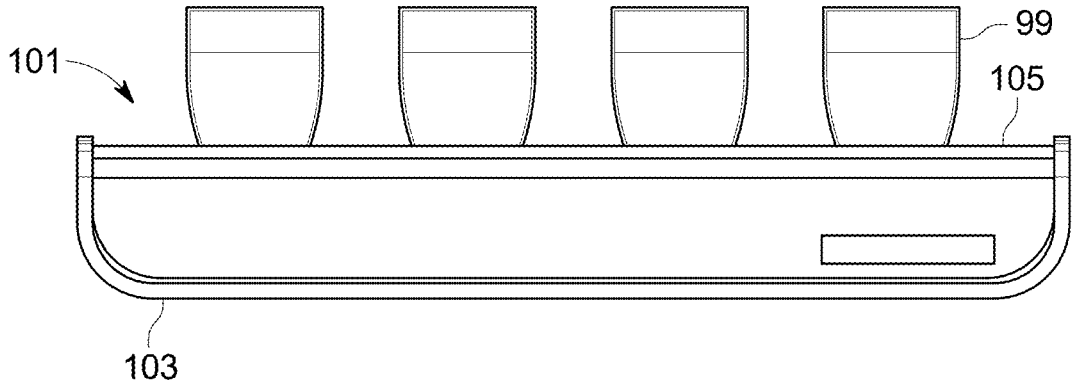
FIG. 2 is a front view of the beverage flight cooler of FIG. 1.

Referring now to FIGS. 1-2 in the drawings, a perspective view and a side view of a beverage flight cooler assembly 101 is provided. Assembly 101 is configured to insulate and regulate the temperature of beverages prior to consumption. By maintaining a regulated temperature, a desired flavor profile for the beverage may be maintained after it has been opened and is ready for consumption. Maintaining a proper temperature helps the beverage remain in a desirable flavor profile for a longer period of time.

As seen in the figures, containers 99 are illustrated. It is understood that assembly 101 may be used to regulate beverages in one or more types of containers. A beverage container 99 may include any type of glass, can, bottle, or item configured to hold liquid. Assembly 101 is configured to accept containers 99 within one or more passages, where in the passages are insulated. It is further understood that an insulated material is one in which it is designed to resist the transfer of heat energy. The precise materials used to insulate containers 99 may be those common in the industry.

Figure 3:
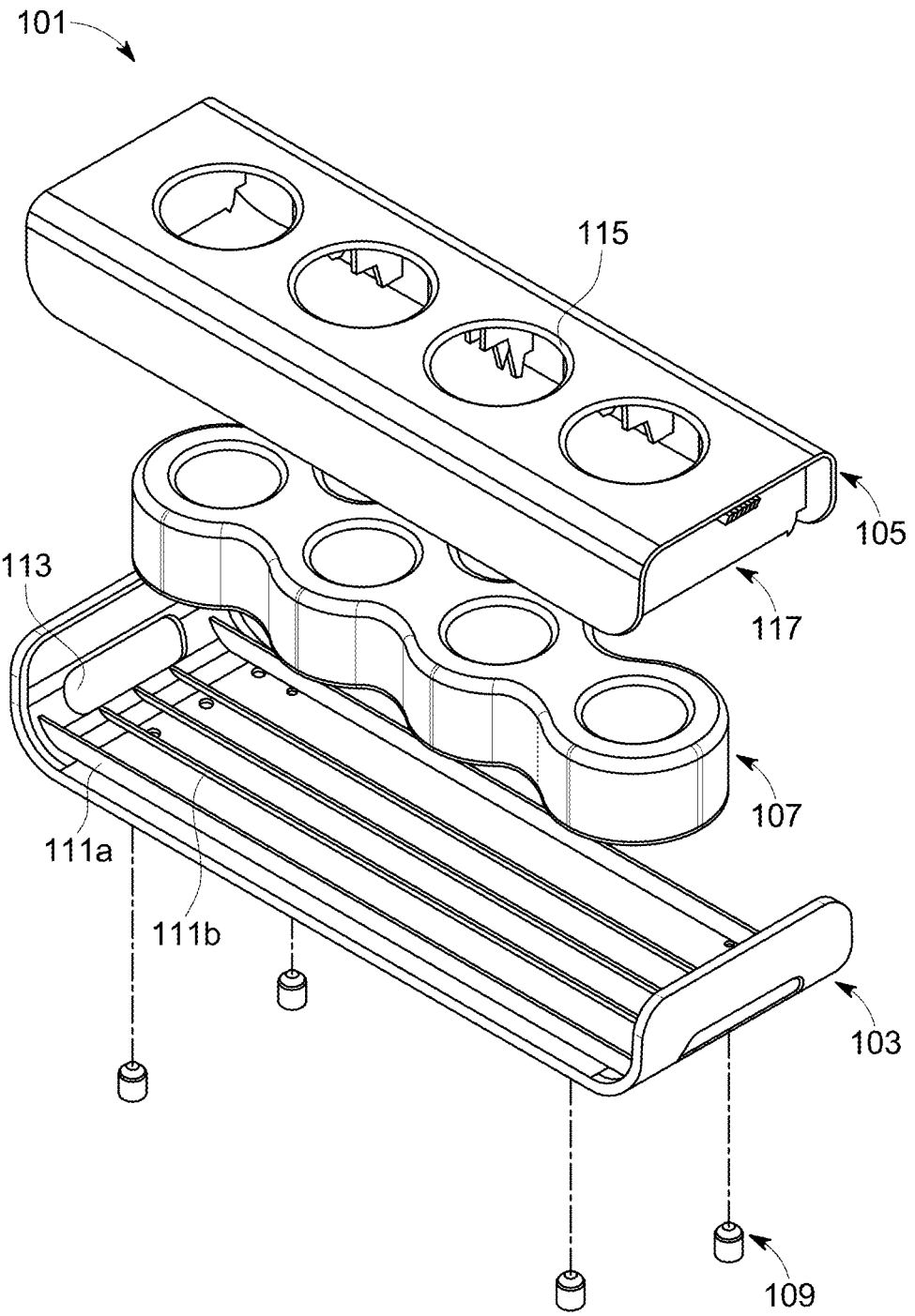
FIG. 3 is an exploded perspective view of the beverage flight cooler of FIG. 1 with containers removed.

Referring now also to FIG. 3 in the drawings, an exploded perspective view of assembly 101 is provided. Assembly 101 includes a cooler case 103, a cooler lid 105, and a cooler pack 107. Cooler pack 107 is more clearly illustrated in FIG. 3 as opposed to those shown in FIGS. 1 and 2. Cooler pack 107 is configured to rest adjacent an inner upper surface of cooler case 103. Cooler case 103 includes a plurality of internal ribs (111*a*/111*b*) configured to elevate cooler pack 107 above that upper surface. Outer ribs 111*a* may be slightly taller than interior ribs 111*b*. Outer ribs 111*a* are configured to provide horizontal stability to cooler pack 107. Interior ribs 111*b* are configured to elevate cooler pack 107 off of the inner upper surface. Any liquid that develops within assembly 101 may pass down and rest below cooler pack 107 between any of the ribs. It is also understood that ribs 111*a* and 111*b* provide rigidity and structural support to the overall assembly.

Cooler case 103 further includes handle apertures 113 formed on opposing ends. Cooler case 103 includes raised ends along its narrow width. The raised ends include apertures 113 that permit a user to handle and control the position of assembly 101. Cooler lid 105 is shown having apertures 115 along its top surface for the passage of containers 99. Also shown in FIG. 3 is the inclusion of an end cap 117 within cooler lid 105. End cap 117 is located at each end of assembly 101. End caps 117 are recessed back or inward from the edge of cooler lid 105. When fully assembled cooler lid 105 rests down a pawn cooler case 103 outside of ribs 111*a* but inside the narrowed raised ends. Having end caps 117 recess provides an interior volume which aligns with apertures 113 to permit the insertion of a user's hand and thereby act or serve as a handle location. End cap 117 can be seen on both sides or both ends of cooler lid 105.

Figure 4:
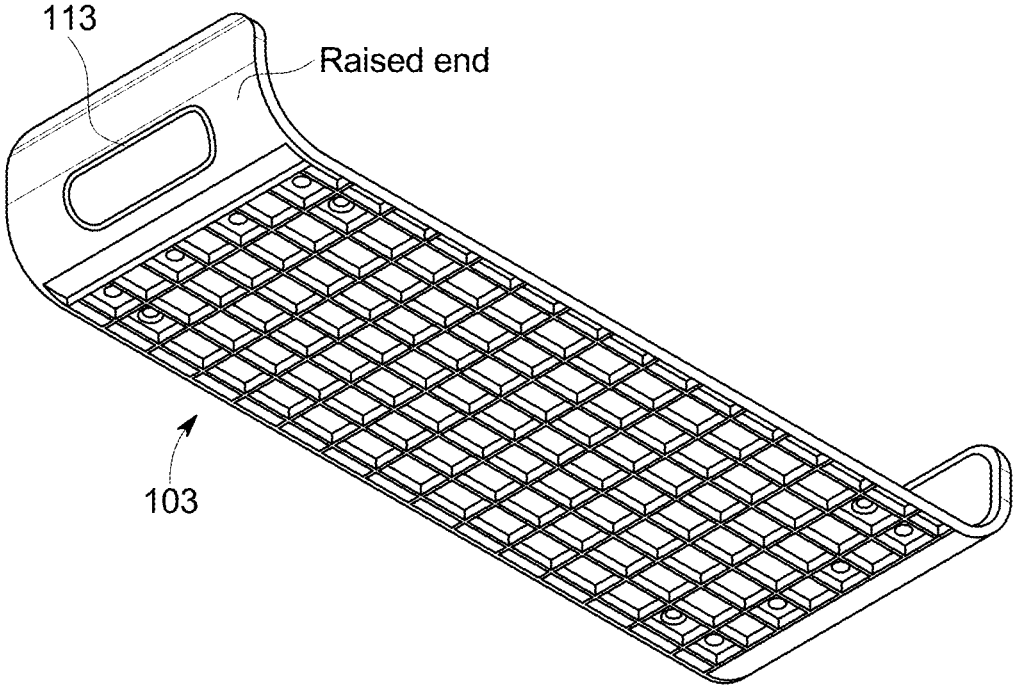
FIG. 4 is a lower perspective view of a cooler case in the beverage flight cooler of FIG. 1.

Referring now also to FIG. 4 in the drawings, a lower perspective view of cooler case 103 is illustrated. It is understood that the lower surface of case 103 may include any number of apertures or protrusions to either provide structural stability and or textured control by a user when gripped. Assembly 101 may further include one or more feet 109 (see FIG. 3) configured to couple to a lower surface of cooler case 103. Feet 109 are configured to provide grip so as to prevent an undesired movement of assembly 101 along a serving surface.

Figure 5:
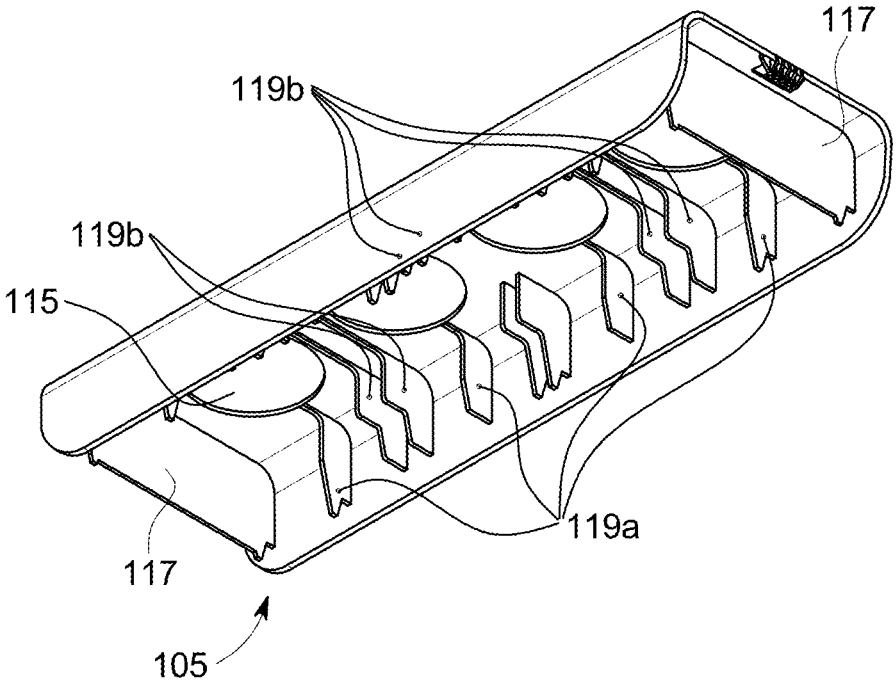
FIG. 5 is a lower perspective view of a cooler lid in the beverage flight cooler of FIG. 1.

Referring now also to FIG. 5 in the drawings, a lower perspective view of cooler lid 105 is illustrated. End caps 117 are more clearly illustrated here. As seen in the figure each end cap is recessed back away from the edge of cooler lid 105. Also shown is a plurality of ribbing in cooler lid 105. Container ribs one 119*a* are those aligned with apertures 115, wherein the ribs extend to but do not pass into or beyond the perimeter of aperture 115. Container ribs 119*b* are those ribs which extend beyond the perimeter of aperture 115 but are offset from and next to apertures 115 such that its extended protrusion does not interfere with the passage of container 99 there through. Container ribs 119*b* typically extend inward from a lower surface within cooler lid 105, further than container ribs 119*a*. It is understood that any number of ribs or end caps and their exact location may be modified from that described or shown in the figures.

Figure 6:
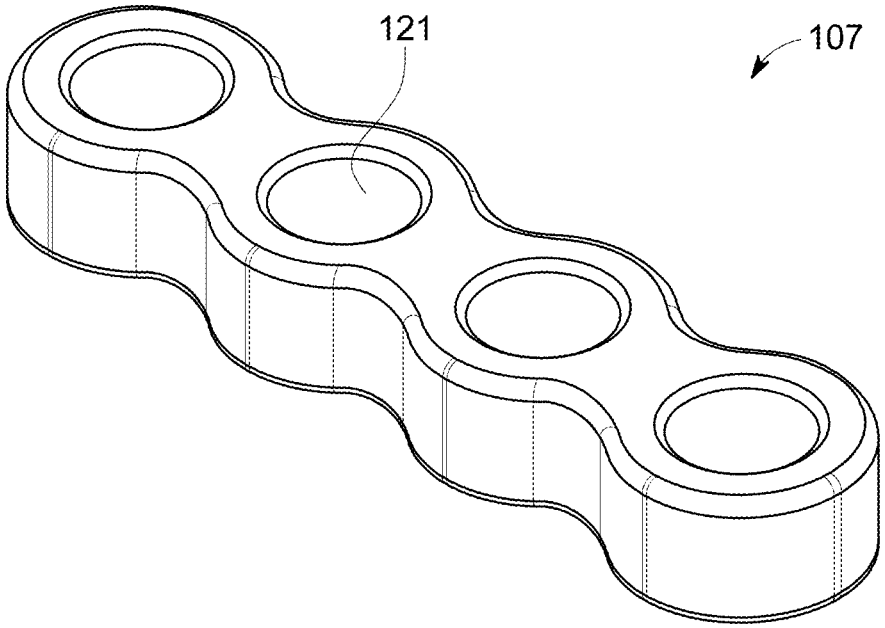
FIGS. 6-7 are front perspective views of an cooler packs in the beverage flight cooler of FIG. 1.
Figure 7:
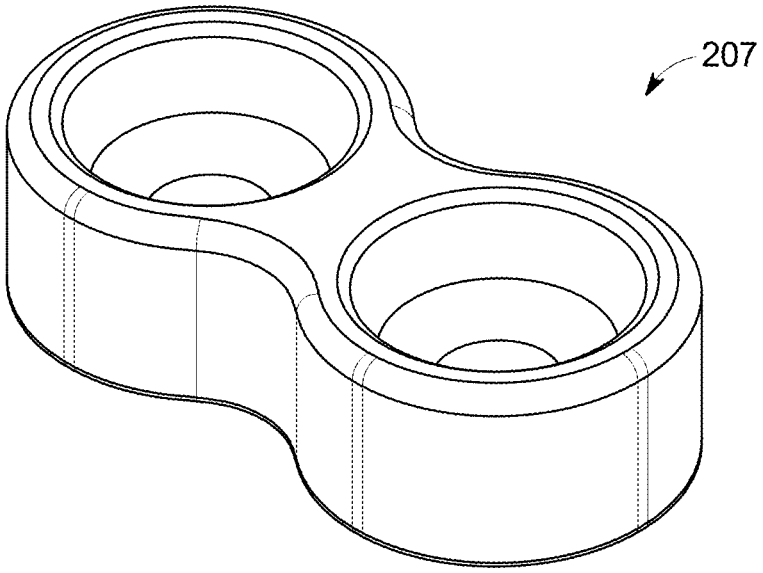

Referring now also to FIGS. 6-7 in the drawings, perspective views of cooler packs are illustrated. The cooler packs are configured to rest upon the ribs on an upper interior surface of cooler case 103 and below cooler lid 105. Cylindrical recesses 121 are formed from an upper surface and are aligned with apertures 115. Containers 99 are configured to pass through aperture 115 and into the recess 121. Being made from insulative material, cooler pack 107 prevents the undesired warming of the beverage. It is understood that at times it is conceivable that the beverages may be warmed wherein it is undesirable that the drinks cool. Therefore, cooler pack 107 is configured to minimize heat transfer into and out of the beverage within container 99.

Cooler pack 207 is similar in form and function to that of cooler pack 107 except wherein the diameter of the recesses are enlarged and the number of recesses are decreased. In pack 107, cans and glasses may be appropriately sized to fit. Whereas, in pack 207, larger containers 99 may be sized into the enlarged recesses. Furthermore, it should be recognized that packs 107/207 may have any number of recesses and/or include recesses that all have matching sizes or recesses of different sizes.

To illustrate some of the variable options with the cooler packs, the following is to be understood. Assembly 101 may therefore include 4 separate cooler packs wherein each pack only has 1 recess. Alternatively, assembly 101 may include 2 cooler packs wherein each pack has 2 recesses. These serve as examples only. Assembly 101 may be sized to include cooler packs of any size having any number of recesses.

Assembly 101 is configured to be disassembled. Packs 107/207 may be removed and replaced as necessary. An example of a need for replacement would be to allow the pack to be temperature conditioned prior to use, as in possibly placing in a cooler to decrease its temperature perhaps. In use, an operator may utilize handle apertures 115 to lift assembly 101 with or without containers 99. A user may keep the beverages within the recesses to maintain temperature until consumed.

The current application has many advantages over the prior art including at least the following described herein. The beverage flight cooler is intended to provide a better beverage sample tasting experience for beer, wine and other beverages by providing an improved consumer perception of beverages. It is a reusable serving container to keep beverages intended to be consumed at cooler temperatures cooler longer and incorporates removable and reusable cooler packs that may be refrigerated or frozen prior to use depending on the beverage(s) being sampled. It is a durable construction which may be made of almost any material and formed into almost any shape and may have a lid that can also have graphical indicia. The materials can be cleaned and sanitized in a dishwasher which is an improvement over absorbent materials such as wood.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A beverage flight cooler assembly comprising:

a cooler case having one or more ribs along an upper surface, the cooler case includes opposing raised ends and a handle aperture formed therein, the handle aperture being located in each of the opposing raised ends;

a cooler lid configured to rest on the cooler case, the cooler lid defining an internal volume, the cooler lid including a plurality of container apertures permitting access into the internal volume; and a cooler pack resting upon the one or more ribs of the cooler case and below the cooler lid, the cooler pack configured to be insulative so as to minimize heat transfer, the cooler pack including a plurality of cylindrical recesses, wherein each one of the plurality of cylindrical recesses is aligned with a respective one of the plurality of container apertures;

wherein the one or more ribs of the cooler case elevate the cooler pack above the upper surface to permit the collection and removal of moisture.

2. The assembly of claim 1, wherein the cooler lid includes an end cap extending inward, the end cap being inset from a perimeter of the cooler lid.

3. The assembly of claim 2, wherein the inset end cap forms an internal volume between the cooler case and the cooler lid adjacent to the handle aperture.

4. The assembly of claim 1, wherein the cooler pack is removable.

5. The assembly of claim 1, wherein the cooler pack is temperature conditioned externally to the cooler lid.

6. The assembly of claim 1, further comprising:

a container resting within the recess and passing through the container aperture.

7. The assembly of claim 1, further comprising:

a foot coupled to a lower surface of the cooler case.

8. A beverage flight cooler assembly comprising:

a cooler case having one or more ribs along an upper surface, the cooler case includes opposing raised ends and a handle aperture, the handle aperture being located in each of the opposing raised ends;

a cooler lid configured to rest on the cooler case, the cooler lid defining an internal volume, the cooler lid including a plurality of container apertures permitting access into the internal volume, the cooler lid includes an end cap extending inward, the end cap being inset from a perimeter of the cooler lid, the inset end cap forms an internal volume between the cooler case and the cooler lid adjacent to the handle aperture;

a removable cooler pack resting upon the one or more ribs of the cooler case and below the cooler lid within the internal volume, the cooler pack configured to be insulative so as to minimize heat transfer, the cooler pack including a plurality of cylindrical recesses, wherein each one of the plurality of cylindrical recesses has an opening aligned with and adjacent to a respective one of the plurality of container apertures; and a container resting within the plurality of cylindrical recesses and passing through the container aperture;

wherein the one or more ribs elevate the cooler pack off an upper surface of the cooler case.

* * * * *